US007594954B2

(12) United States Patent
Riskin

(10) Patent No.: US 7,594,954 B2
(45) Date of Patent: Sep. 29, 2009

(54) METHOD OF AIR PURIFICATION FROM DUST AND ELECTROSTATIC FILTER

(76) Inventor: Yefim Riskin, 30 Dovrat Street, Katzrin 12900 (IL)

( * ) Notice: Subject to any disclaimer, the term of this patent is extended or adjusted under 35 U.S.C. 154(b) by 98 days.

(21) Appl. No.: 11/889,827

(22) Filed: Aug. 16, 2007

(65) Prior Publication Data

US 2008/0250926 A1 Oct. 16, 2008

(30) Foreign Application Priority Data

Apr. 10, 2007 (IL) ..... 182389

(51) Int. Cl.
*B03C 3/14* (2006.01)

(52) U.S. Cl. ..... 95/78; 55/DIG. 38; 96/60; 96/62; 96/96

(58) Field of Classification Search ..... 95/78; 96/60–64, 96; 55/DIG. 38
See application file for complete search history.

(56) References Cited

U.S. PATENT DOCUMENTS

| | | | | | |
|---|---|---|---|---|---|
| 1,024,784 | A * | 4/1912 | Johnson, Jr. | ..... | 96/61 |
| 1,291,745 | A * | 1/1919 | Bradley | ..... | 423/519 |
| 1,430,246 | A * | 9/1922 | Meredith | ..... | 204/563 |
| 2,114,682 | A * | 4/1938 | Gumaer | ..... | 95/79 |
| 3,167,666 | A * | 1/1965 | Janner et al. | ..... | 310/309 |
| 3,526,081 | A * | 9/1970 | Kusters | ..... | 96/61 |
| 3,585,060 | A * | 6/1971 | Gourdine et al. | ..... | 427/460 |
| 3,803,808 | A * | 4/1974 | Shibuya et al. | ..... | 96/54 |
| 3,994,704 | A * | 11/1976 | Shibuya et al. | ..... | 96/60 |
| 5,466,279 | A | 11/1995 | Hattori et al. | | |
| 5,683,494 | A * | 11/1997 | Altman et al. | ..... | 96/55 |
| 5,779,769 | A * | 7/1998 | Jiang | ..... | 96/55 |
| 6,497,754 | B2 | 12/2002 | Joannou | | |
| 6,527,829 | B1 * | 3/2003 | Lehtimäki et al. | ..... | 95/71 |
| 6,635,106 | B2 | 10/2003 | Katou et al. | | |
| 6,926,758 | B2 * | 8/2005 | Truce | ..... | 95/78 |
| 7,112,236 | B2 * | 9/2006 | Hoverson et al. | ..... | 95/78 |
| 7,264,658 | B1 * | 9/2007 | Heckel et al. | ..... | 96/62 |
| 2005/0223893 | A1 * | 10/2005 | Hoverson et al. | ..... | 95/57 |

FOREIGN PATENT DOCUMENTS

WO WO 91/16528 A1 * 10/1991

* cited by examiner

*Primary Examiner*—Richard L Chiesa
(74) *Attorney, Agent, or Firm*—Pearl Cohen Zedek Latzer, LLP

(57) ABSTRACT

A method for air purification from dust includes electrically charging dust by air ionization; and collecting the charged dust by an electric field force, performed in a common airflow while changing the direction of the airflow at least once by an angle of more than 135°.

6 Claims, 2 Drawing Sheets

A - A

METHOD OF AIR PURIFICATION FROM DUST AND ELECTROSTATIC FILTER

CROSS REFERENCE TO RELATED APPLICATIONS

This application claims priority from Israeli Patent Application Number 182389, filed on Apr. 10, 2007, which is incorporated in its entirety herein by reference.

FIELD OF THE INVENTION

The present invention relates to a method for air purification and an electrostatic filter therefor.

BACKGROUND OF THE INVENTION

Methods of dust charging are known, in which the dust is charged with corona discharge in electric field. Corona discharge is generated between a lengthy electrode (usually thin wire) and a passive electrode. Discharge electrode in located between the passive electrodes or next to them.

The airflow direction in such devices as U.S. Pat. No. 6,635,106 and U.S. Pat. No. 5,466,279 is perpendicular to the discharge electrode axis and to the direction of the electric field lines.

The airflow direction in U.S. Pat. No. 6,497,754 is perpendicular to the discharge electrodes axis; however it is parallel to the electric field lines between the discharge and passive electrodes.

In the above-mentioned patents, dust collection is effected by way of electric field generation between flat conducting parallel plates. In the above-mentioned patents, charging and collection of dust is effected inside the airflow moving in a single direction.

Major drawbacks of the mentioned devices stem from the short time of dust charging that occurs in a strong electric field with high concentration of ions.

The first drawback is the low efficiency of charging, particles with diameter smaller than 2 μk are charged not under the effect of the electric field but mainly as a result of time in a consuming ions diffusion process.

In diffusion charging the particles charge is proportional to their diameter.

Another drawback of the known devices is the high level of ozone produced as a byproduct of corona discharge during dust charging.

In these patents, non-coincidence of the discharge electrode axis with the airflow direction results in one more drawback, in that the discharge electrode surface is contaminated by dust particles in the form of hair which catch the electrode. This results in the need in pre-filters or periodic cleaning of discharge electrodes.

Since the efficiency of the dust collection is proportional to the length of collecting electrodes, in order to improve filter efficiency the length of collection electrodes and consequently the length of the entire filter must be increased.

In many cases this restricts the use of such filters, e.g. in ceiling ventilation systems where the filter length is restricted by the inter-ceiling space.

SUMMARY OF THE INVENTION

The present invention relates to a method of air purification from dust, and an electrostatic filter, in which the processes of charging and collection of dust are separated and are performed in different devices. This method of purification and filter can be applied industrial conditions and/or at home.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
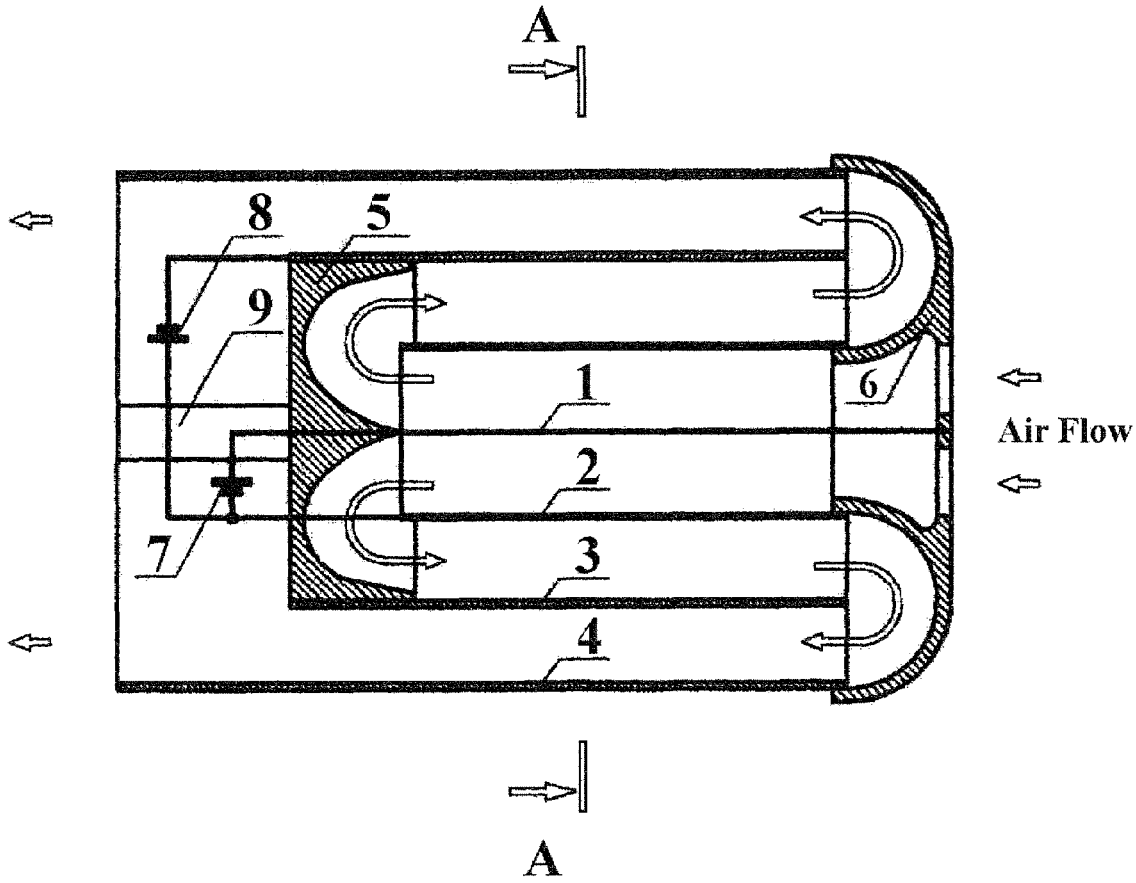
FIG. 1 is a schematic illustration of the construction of an electrostatic filter according to embodiments of the present invention.

It will be appreciated that for simplicity and clarity of illustration, the drawings are schematic illustrations that may not include every element of the devices according to the present invention, but illustrate the concepts of the present invention, and that elements shown in the figures have not necessarily been drawn to scale.

DETAILED DESCRIPTION OF THE INVENTION

The objective of the present invention is to eliminate the drawbacks of the existing filtration methods and electrostatic filters.

In the offered method of air purification from dust that includes dust charging in corona discharge electric field, the objective is achieved by charging the dust particles in corona discharge that occurs in a weak and elongated electric field. Such field is generated between wire corona electrode and hollow passive electrode (for example a pipe). Discharge electrode is mounted inside a hollow electrode such that the axis of the discharge electrode coincides with the direction of the airflow in the hollow electrode.

In this manner substantially the diffusion charging of dust is provided which is very important for charging of particles smaller than 2 μk. Since the dust charge $q=C_n \cdot t$, where $C_n$ is the ions concentration and t is the charging time, increase of the charging duration by one order of magnitude enables a reduction in the ions concentration by the same order of magnitude. Moreover, the ozone concentration is reduced by the same order of magnitude.

Coincidence of the corona electrode axis with the airflow direction results in additional drop of ozone concentration.

This is because of two chemical reactions taking place during the corona discharge in air.

The first process is ozone generation due to dissociation of oxygen molecule into two atoms:

$$2O+O_2=O_3+O$$

The length of life of non-associated oxygen atoms is short and if ozone moves along the discharge electrode instead of being removed from it a second chemical process, i.e. ozone dissociation, occurs:

$$O_3+O=2O_2,$$

which results in reduction of the ozone concentration.

Another advantage of the discharge electrode axis coincidence with the airflow direction is zero contamination of the discharge electrode. The reason is that during charging dust particles are removed from the discharge electrode.

In order to achieve another objective of the invention, i.e. to improve the efficiency of dust collection without increasing the length of the entire electrostatic filter, in the proposed invention the airflow direction is changed at least once by an angle of more than 135°.

In this approach the dust collection process may be multi-stage, moreover in each following stage the dust collection is effected in airflow whose direction is altered by an angle of more than 135° relatively to the previous stage.

In the proposed invention the first operation of dust collection is also separated from the dust charging operation by an operation of airflow direction change by an angle of more than 135°, which enables the determination of the length of the electrostatic filter such that it will be equal to that required for dust charging operation.

The electrostatic filter of the present invention that realizes the advantages of the method of the present invention includes a dust charging device, a device for at least a single-stage dust collection procedure, and at least one airflow direction changing device.

The filter also has a high voltage source for the dust charging and collection devices.

FIG. 1 is a schematic illustration of the construction of an electrostatic filter according to embodiments of the present invention.

The filter includes: wire discharge electrode 1, hollow passive electrodes 2 and 4, made from conducting material, hollow collecting electrode 3 also made from conducting material, airflow direction changing devices 5 and 6 made from insulation material, high voltage power supplies 7 and 8, as well as cage 9 made from insulation material.

Dust charging device may include discharge electrode 1 and passive electrode 2 which are connected to high-potential and low-potential terminals of the high voltage power supply 7 respectively.

Discharge electrode 1 is mounted inside hollow passive electrode 2 so that its axis is in line with the direction of the airflow inside electrode 2.

Dust collection device includes the first stage of collection which is formed from the outer side of electrode 2 and inner side of electrode 3 and the second collection stage which is formed from the outer side of electrode 3 and inner side of electrode 4.

In order to reduce the price and the weight of the filter all the electrodes 2, 3, 4 can be realized as a conducting coating applied on the insulating support, which will make it possible to use electrode 4 as a filter cage.

Passive electrode 2 and 4 are interconnected and connected to the low-potential terminal of the high voltage power supply 8, while electrode 3 is connected to the high-potential terminal of this power supply.

Airflow direction changing device 5 is mounted between the dust charging device and the first stage of the dust collector.

In fact, device 5 blocks one end of the hollow collecting electrode 3, therefore the airflow passes first inside electrode 2 and then between the outer side of electrode 2 and the inner side of electrode 3 in the opposite direction.

Airflow direction changing device 6 mounted between the first and the second dust collection stages directs the airflow passing between the outer side of electrode 2 and inner side of electrode 3 into the space between the outer side of electrode 3 and inner side of electrode 4 where the airflow direction is changed to the opposite.

Moreover, the distance between devices 5 and 6 and the ends of hollow electrode 2 and 3 is such that the airflow density at the direction change location remains unchanged.

Figure 2:
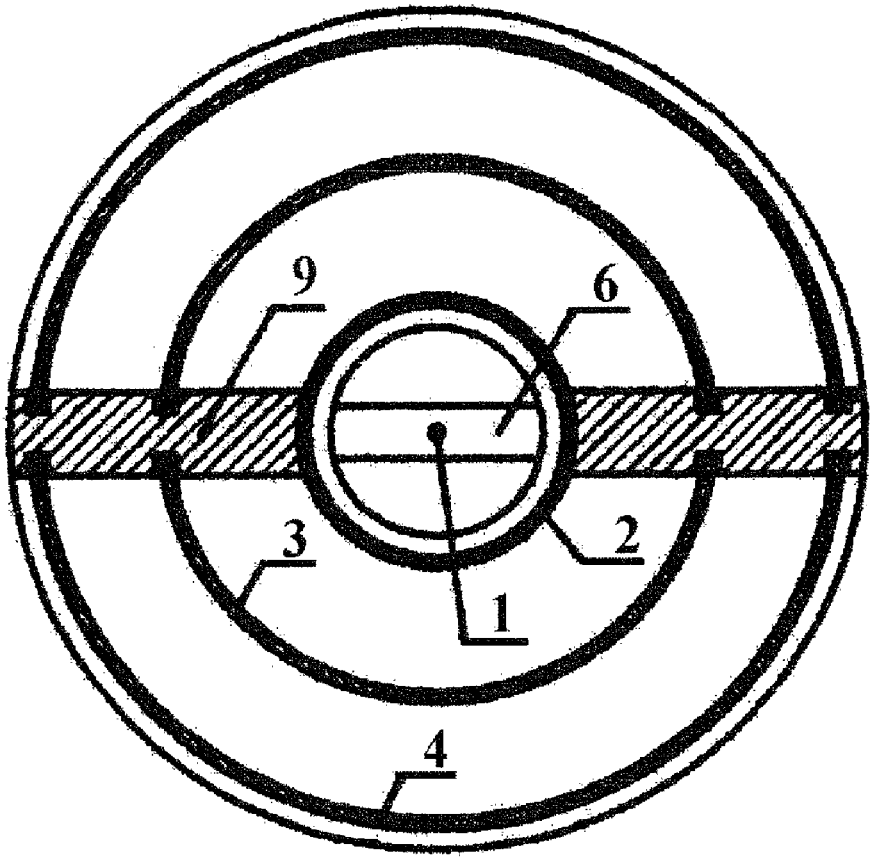
FIG. 2 is a schematic illustration of the construction of an electrostatic filter in section according to an embodiment of the present invention.

FIG. 2 is a schematic illustration of the construction of an electrostatic filter in section according to an embodiment of the present invention.

It can be seen from FIG. 2 that actually all the filter elements 1, 2, 3, 4, 5, and 6 are mounted on cage 9.

High voltage power supplies 7 and 8 can be fastened to the cage 9 too, however they can be external with relation to the filter.

In order to facilitate the procedure of collecting electrode 3 extraction from the filter for cleaning from dust, this electrode as well as electrode 4 are formed with several fragments, as can be seen from FIG. 2. The fragments are electrically connected to each other.

Further technical specification of an embodiment of electrostatic filters that realizes the present invention is detailed below:

| | |
|---|---|
| 1. Length of hollow electrodes | 20 cm |
| 2. Diameters of hollow electrodes: | 1-5 cm, 2-7 cm, 3-9 cm |
| 3. Corona electrode current | $11 \cdot 10^{-6}$ A |
| 4. Voltage across collector electrode | 8 kV |
| 5. Airflow velocity | 2 m/sec |
| 6. Efficiency of air purification from dust particles with diameter of up to 0.3 μ | 95% |
| 7. Ozone ($O_3$) level | 1 ppb |

While certain features of the invention have been illustrated and described herein, many modifications, substitutions, changes, and equivalents may now occur to those of skill in the art. It is therefore to be understood that the appended claims are intended to cover all such modifications and changes as fall within the spirit of the invention.

What is claimed is:

1. A method for air purification from dust comprising:

electrically charging dust by means of air ionization; and collecting the charged dust by means of an electric field force, performed in a common airflow, wherein the direction of the airflow is changed at least twice by an angle of more than 135°, once between the step of electrically charging the dust and the step of collecting the charged dust and once during the step of collecting the charged dust, where dust is influenced by the electric field.

2. The method according to claim 1, wherein the step of collecting the charged dust is performed more than once during the step of collecting the charged dust.

3. An electrostatic filter comprising: a dust charging device, a dust collector having at least one section, high voltage power supplies for applying an electric field through which an airflow is provided, which includes at least two direction-changing devices for changing the direction of the airflow passing through by an angle of more than 135°, one direction changing device located between the dust charging device and the dust collector and one direction-changing device located within the dust collector where dust is influenced by the electric field.

4. The electrostatic filter according to claim 3 in which more than one direction-changing device are located within the dust collector, each direction changing device is mounted between sections of the dust collector.

5. The electrostatic filter according to claim 3 further comprising a hollow collecting electrode mounted between two hollow grounded electrodes in which an outer hollow grounded electrode and the collecting electrode are formed with at least two fragments, the fragments of each electrode being electrically connected.

6. The electrostatic filter according to claim 3 in which the dust collector includes a wire corona electrode and is mounted inside a hollow passive electrode so that the direction of the corona electrode axis coincides with the direction of airflow in the hollow electrode.

* * * * *